United States Patent [19]

Thompson

[11] Patent Number: 4,752,073

[45] Date of Patent: Jun. 21, 1988

[54] LOTTO CARD READER

[76] Inventor: Clifford F. Thompson, 4343 Jacinto Dr., Fremont, Calif. 94536

[21] Appl. No.: 122,707

[22] Filed: Nov. 19, 1987

[51] Int. Cl.[4] ..... A63F 3/06

[52] U.S. Cl. ..... 273/148 R; 434/353

[58] Field of Search ..... 273/148 R, 269, 281; 434/353

[56] References Cited

U.S. PATENT DOCUMENTS

| | | | |
|---|---|---|---|
| 3,823,944 | 7/1974 | Stubbmann | 273/281 |
| 3,868,782 | 3/1975 | Burchette | 434/353 |
| 4,381,112 | 4/1983 | Dupuy | 273/281 X |

FOREIGN PATENT DOCUMENTS

| | | | |
|---|---|---|---|
| 457588 | 6/1949 | Canada | 273/270 |
| 1247834 | 8/1967 | Fed. Rep. of Germany | 273/269 |
| 2549131 | 5/1977 | Fed. Rep. of Germany | 273/148 R |
| 2810650 | 9/1979 | Fed. Rep. of Germany | 273/148 R |
| 1037967 | 5/1953 | France | 273/270 |
| 2417347 | 10/1979 | France | 273/270 |
| 2421649 | 12/1979 | France | 273/148 R |
| 2560057 | 8/1985 | France | 273/269 |
| 2567031 | 1/1986 | France | 273/148 R |
| 447909 | 3/1968 | Switzerland | 273/270 |
| 609875 | 3/1979 | Switzerland . | |
| 1251884 | 11/1971 | United Kingdom | 273/270 |

*Primary Examiner*—Anton O. Oechsle

*Attorney, Agent, or Firm*—Harris Zimmerman; Howard Cohen

[57] ABSTRACT

Examination of lottery tickets or other game cards to detect winning combinations of marked numbers is facilitated by a compact reader device having a slot into which the lottery ticket can be inserted. The body of the device including the slot is transpierced by an array of passages corresponding to the array of numbers on the lottery ticket. Each passage contains an opaque slider element which may be shifted between opposite end regions of the passage prior to insertion of a lottery ticket to enable viewing of winning number locations on the ticket and to cover the locations of non-winning numbers when the inserted ticket is viewed through the passages. A key, which can be clamped to the body of the device, is used to position the slider elements prior to insertion of the lottery ticket.

14 Claims, 3 Drawing Sheets

LOTTO CARD READER

TECHNICAL FIELD

This invention relates to accessories for games and more particularly to a device for facilitating the examination of lottery tickets or the like to determine if winning combinations of marked numbers are present on the ticket.

BACKGROUND OF THE INVENTION

Lottery tickets and certain other forms of game card, such as some types of Bingo card for example, have an array of numbers or other symbols imprinted on the ticket or the like. The player crosses out or otherwise marks a selected combination of the numbers with a pen or by other means in an effort to predict a series of numbers that will be determined later at a drawing or other chance procedure.

When the winning combinations of numbers is announced, the players must examine their tickets to ascertain if they had marked that particular set of numbers. This can be somewhat time consuming and subject to error. Many lottery tickets have arrays of numbers which are small and closely spaced. Such tickets often have several repetitive arrays of the numbers each of which must be scanned to determine if the winning combination has been marked in one or more of them. Players often purchase a number of tickets in a single game thereby further complicating the task of examining the arrays of numbers to locate a winning selection.

Lottery tickets or the like may be imprinted on cards designed for machine reading by the organization conducting the lottery. The complex and costly data processing equipment used for this purpose is not available to the typical player.

Less costly devices have heretofore been devised for the purpose of facilitating the examination of lottery tickets or the like by players. Prior devices of this type may, for example, have means for receiving the tickets and a series of slidable pointers which can be positioned at the locations which winning numbers occupy on the tickets. The player can then readily observe if the numbers adjacent each pointer are marked numbers. In another form, the device is opaque and has an array of small windows at the location of the numbers on the ticket. A small opaque hinged cover at each window enables covering of all windows except those which are at the locations of winning numbers on the ticket. When the winning combination of numbers is announced, the player opens only those windows which correspond to the locations of the winning numbers on the lottery ticket. One or a series of marked tickets may then be positioned in the device and the presence of a winning ticket is immediately apparent as, in that case, markings are visible at all open windows.

Prior lottery card reading devices of the above described form require small moving parts, such as sliding pointers or hinged flaps, of a type that complicate manufacture and thereby adversely affect the costs of the devices. These somewhat fragile parts are externally exposed and susceptible to damage. Manipulation of the parts to accommodate to a new set of winning numbers can require delicate operations and be readily susceptible to error, particularly when the numbers on the ticket are small and closely spaced.

The present invention is directed to overcoming one or more of the problems discussed above.

SUMMARY OF THE INVENTION

In one aspect, the present invention provides a device for examining game tickets or the like of the type having an array of numbers or other symbols, selected ones of the numbers of other symbols having been marked to forecast a set of winning numbers or symbols. The device includes body member having first and second opposite faces and having a slot situated between the faces, the slot being proportioned to receive at least the portion of the ticket that carries the array of numbers or symbols. A plurality of passages extend through the body member including the slot, the passages being located in an array which corresponds to the array of numbers or other symbols on the ticket. The first face of the body member has markings which identify each passage with the corresponding one of the numbers or other symbols of the ticket. One of a plurality of slider elements is disposed in each passage and is movable within the passage between a first position at which it is located between the slot and the first face and a second position at which it is located between the slot and the second face.

In another aspect, the invention provides a checking device for identifying winning lottery tickets or the like that have an array of distinct numbers or other symbols. The device includes a body member having a face and a slot extending in parallel relationship to the face, the slot being proportioned to receive the lottery tickets or the like and to maintain the tickets or the like in parallel relationship to the face. The body member including the slot is transpierced by a plurality of passages which are disposed in an array corresponding to the array of numbers or other symbols on the lottery ticket or the like. Markings on the face correlate individual ones of the passages with corresponding ones of the numbers or other symbols of the lottery tickets or the like. The device further includes a plurality of opaque slider elements each being disposed in a separate one of the passages for movement between first and second opposite end regions of the passage, the slider elements being proportioned to be out of the slot when at the first and second opposite end regions of the passages.

The slider elements are normally positioned between the slot and the face of the device and thus the slot region is not visible from the face of the device. When a set of winning numbers is announced, the player uses a key like instrument to push slider elements to the other ends of their passages at the particular passages that correspond to the winning numbers. The slot region is then visible only through the particular passages which lead to the locations of winning numbers on a ticket when it is inserted into the slot. A winning ticket can be identified at a glance as a marked number is seen at each open passage. The device is structurally simple, can be economically manufactured and does not have delicate moving parts at the external regions of the device. Setting of the device to detect a particular combination of winning numbers requires only insertion of the key like element into several passages and pushing motions which manipulations can be quickly and easily effected.

DETAILED DESCRIPTION OF THE PREFERRED EMBODIMENT

Figure 1:
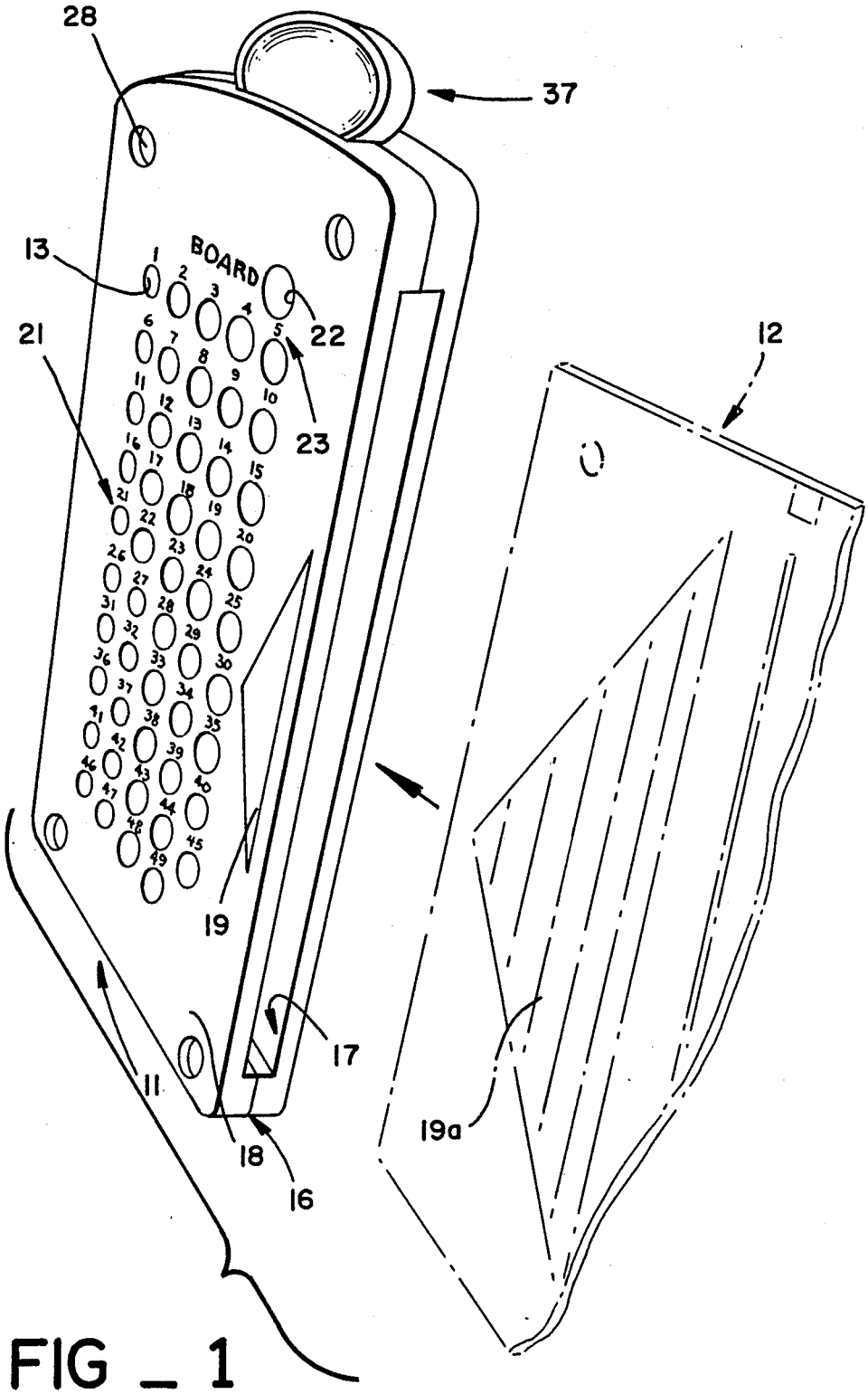
FIG. 1 is a perspective view of a lottery ticket reader in accordance with a preferred embodiment of the invention.

Referring initially to FIG. 1 of the drawings, a lottery ticket reader 11 of this particular example of the invention is designed to read a specific form of lottery ticket 12, a State of California lottery Lotto ticket, and certain of the structural aspect to be herein described are designed to accomodate to that particular lottery ticket. These structural aspects, such as the arrangement of number viewing passages 13 for example, can be modified as necessary to accomodate to other lottery tickets or cards having other proportions and formats.

Figure 2:
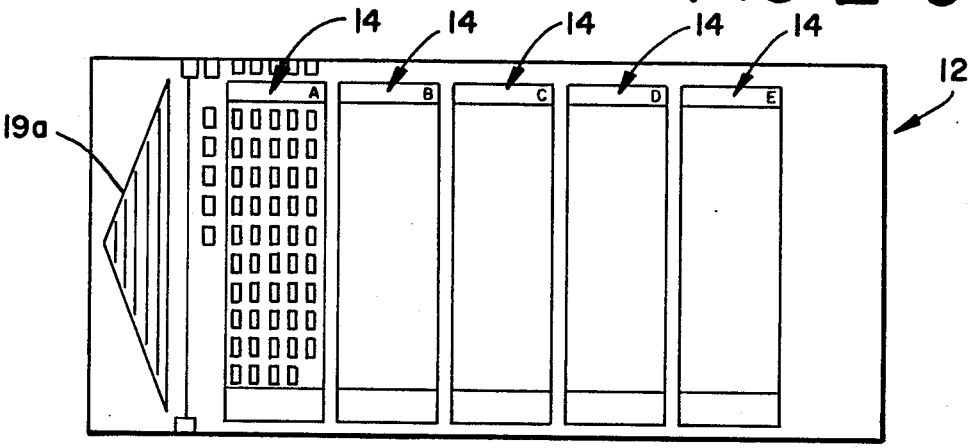
FIG. 2 is a representation of the particular lottery ticket or card which the device of FIG. 1 is designed to read.

Referring to FIG. 2, the particular lottery ticket 12 which is read with the help of the present example of the invention is rectangular and has five similar arrays 14 of numbers imprinted on the face of the ticket, each array containing the numbers one to forty nine starting at the upper left hand corner of the array as viewed in FIG. 2. The imprinted numbers are at the same location in each array 14 and the successive arrays are identified by the letters A, B, C, D and E imprinted on the ticket just above the upper right hand corner of the array.

Each of the arrays 14 constitutes a separate game and the cost of the ticket depends on how many of the arrays the purchaser chooses to mark. The player selects and scratches out six numbers in each array which he has chosen to play in an effort to anticipate the winning number combination which will later be announced for the particular game.

Referring again to FIG. 1, the card reader 11 has a flat body member 16 which is slightly longer than the narrower dimension of the lottery ticket 12 and has a ticket receiving slot 17 which extends parallel to the face 18 of the body that will be viewed during reading of the ticket. A triangle 19 imprinted on or formed in the face 18 is similar to that triangle 19*a* imprinted on one end of the particular lottery ticket identified above and serves to indicate that a lottery ticket is being entered in the slot in the correct orientation.

Body member 11 is transpierced by an array 21 of small passages 13 which conform in number, spacing and arrangement with any individual one of the number arrays 14 (see FIG. 2) imprinted on the ticket 12. Thus, with reference to FIGS. 1 and 2 in conjunction, individual ones of the passages 13 overlay individual number locations in a particular array 14 on the ticket 12 provided that the ticket is fed into the slot 17 a distance sufficient to bring that number array into register with the passages.

A small opening 22 extends from the face 18 to slot 17 adjacent the passage array 21 to enable proper registering of the ticket 12 during use. Opening 22 is located to overlay the identifying letter A, B, C, D or E on ticket 12 when the number array 14 corresponding to that letter is in register with the passages 13. Thus the letter is visible through opening 22 when the ticket 12 is in register with passages 13.

Numbers 23 are imprinted or otherwise marked on face 18 of the card reader 11 adjacent each passage 13 to identify the passage with the number which is imprinted at the corresponding location on ticket 12 when the ticket is registered as described above.

Figure 3:
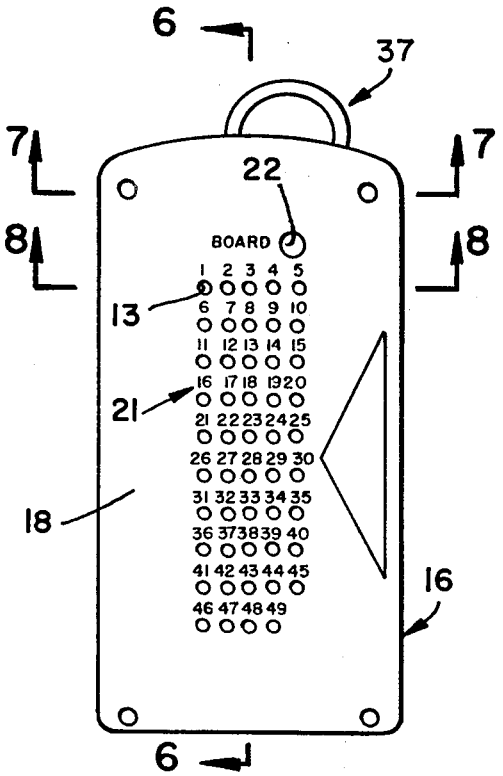
FIG. 3 is a front view of the device of FIG. 1.
Figure 5:
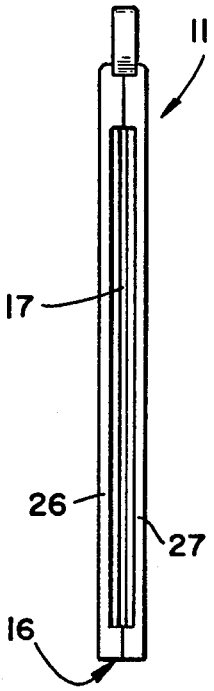
FIG. 5 is a side view of the device of the preceding figures.
Figure 6:
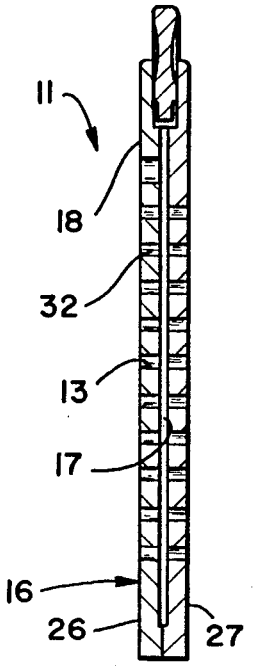
FIG. 6 is a longitudinal section view of the lottery card reader taken along line 6—6 of FIG. 3.
Figure 4:
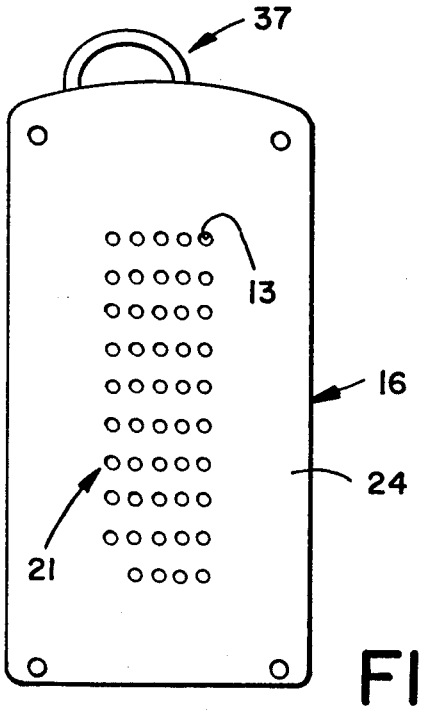
FIG. 4 is a back view of the device of the preceding figures.

As may be seen by reference to FIGS. 3 and 4 in conjunction, passages 13 extend through the body member 16 and are accessible from the back face 24 of the member as well as from the front face 18. Referring jointly to FIGS. 5 and 6, all of the passages 13 intersect the ticket receiving slot 17.

Figure 7:
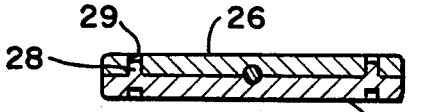
FIG. 7 is a cross section view of the device taken along line 7—7 of FIG. 3.
Figure 8:
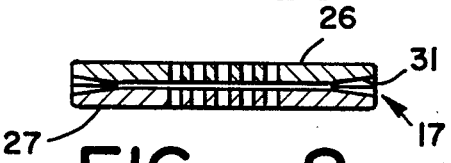
FIG. 8 is a cross section view of the lottery card reader taken along line 8—8 of FIG. 3.

Body member 16 is formed by joining two plate like elements 26 and 27 in parallel relationship, the elements being indented except at the end regions to form the ticket receiving slot 17 which is between the two elements. Referring jointly to FIGS. 7 and 8, the elements 26 and 27 may be secured together at the end regions by projections 28 on one element which are friction fitted into passages 29 in the other elements. The indentations 31 in the two elements 26 and 27 which define the ticket receiving slot 17 become progressively deeper as they approach each end region of the slot to provide a flared configuration at each end of the slot that facilitates entry of a lottery ticket. The elements 26 and 27 may be formed of plastic although other materials are also suitable. The material of which the body member 16 is formed is preferably opaque or at least semiopaque at least in the region of the passages 13.

Figure 10:
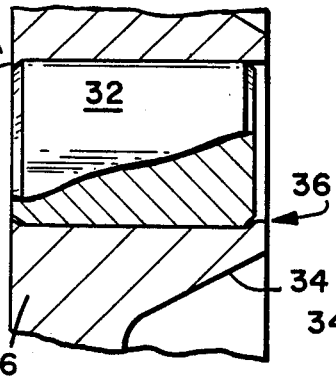
FIG. 10 is a further enlargement showing the lower left portion of FIG. 9.
Figure 9:
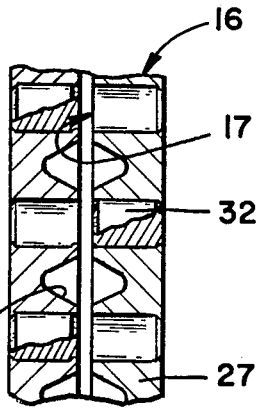
FIG. 9 is an enlarged section view corresponding to a central portion of FIG. 6 but with certain elements shown in moved positions.

Referring jointly to FIGS. 9 and 10, one of a plurality of opaque slider elements 32 is disposed in each passage 13. Slider elements 32 are cylindrical and are oriented in coaxial relationship with the passages 13. Each slider element 32 has a length which is smaller than the thickness of a single body member element 26 or 27. Thus each slider element 32 may be positioned at either end region of a passage 13 without obstructing the ticket receiving slot 17.

Means 33 are provided for preventing ejection of the slider elements 32 from passages 13 and for providing a detenting action which acts to hold each slider in position when it is at either end region of the passage 13. Such means 33 in this example includes an annular lip 34 formed in body member elements 26 and 27 at each end of each passage 13 and which extends a small distance inward toward the axis of the passage to form a seat for the slider element. Slider elements 32 are fitted into the passages 13 prior to assembly of the body member elements 26 and 27 and lips 34 prevent removal of the slider elements as long as the device remains assembled.

The material of the body member 16 is slightly resilient and this property is used to provide a detecting action which acts to hold each slider element 32 at either end region of the passage 13 until sizable axial force is applied. In particular, the body member elements 26 and 27 are formed with conical indentations 34 at the inner surfaces between adjacent ones of the passages 13. A tang like portion 36 of the material between each passage 13 and an indentation 34 is slightly deformed during manufacture to cause it to extend a small distance into the travel path of the slider element 13. Application of sufficient axial force to the slider element 13 causes deflection of the tang 36 allowing the slider to be traveled from one end regions of passage 13 to the other.

Figure 11:
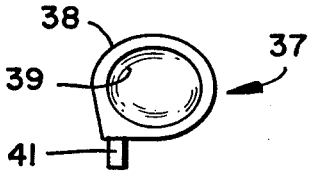
FIG. 11 is a side view of a key which is used to set the device of the preceding figures.
Figure 12:
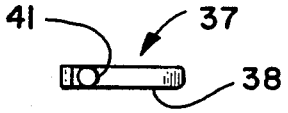
FIG. 12 is a bottom view of the key of FIG. 11.

A key like instrument 37, depicted in FIGS. 11 and 12, facilitates shifting of the slider elements 32 between end regions of the passage 13. The key 37 of this embodiment of the invention has an oval handle portion 38 with shallow indentations 39 on each side shaped to be grasped by the fingers of a player. Referring to FIGS. 9 and 11 in conjunction, a cylidrincal shank protuberance 41 extends from handle 38 and is proportioned for insertion into the passages 13 in order to translate the slider elements along the passages.

Figure 13:
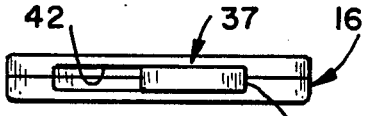
FIG. 13 is a view of one end of the device of the preceding figures.
Figure 14:
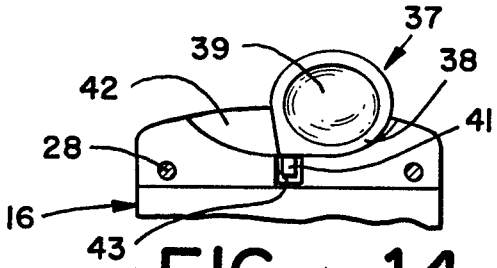
FIG. 14 is a broken out view of the end region of the lottery card reader.
Figure 15:
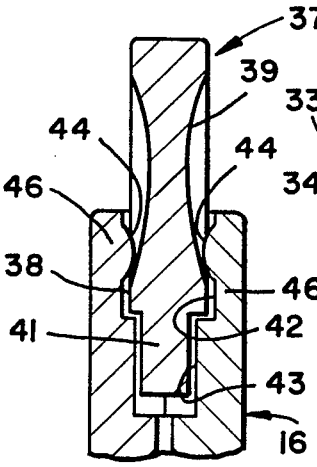
FIG. 15 is an enlargement of the upper end portion of FIG. 6.

Key 37 is preferably arranged to be attachable to the body member 16 when not in use. Referring jointly to FIGS. 13, 14 and 15, a slot 42 is provided in one end of the body member 16 into which the shank 41 and an adjacent portion of handle 38 may be inserted, a passage 43 being provided at the base of the slot to receive the shank. Detect lobes 44 which protude from the opposite walls 46 of slot 42 are normally spaced apart a distance less than the thickness of key handle 38 but the resiliency of the material of the body member 16 enables the handle to be forced between the lobes which then enter the handle indentations 39 and thereby clasp the key 37 to the body member until such time as it is forcibly withdrawn.

In operation, with reference again to FIG. 6, slider elements 32 are initially positioned between the ticket receiving slot 17 and the front face 18 of the card reader 11 and thus the slot region is not visible through passages 13 from the front of the device. When a winning combination of numbers is announced, the player then uses key 37 to force the particular slider elements 32 that are in the passages 13 which correspond to those numbers to the opposite end regions of their passages 13 at the opposite side of slot 17. Thus the slot 17 region is then visible, from the front of the card reader 11, only at the locations which correspond go the winning numbers.

Referring again to FIGS. 1 and 2 in conjunction, the player than inserts the lottery ticket 12 into slot 17 and registers the first array 14 of numbers by bringing the letter A on the ticket to window 22. A winning ticket is instantly identifiable by examination of the face 18 of the device as all visible numbers on such a ticket will be scratched out or otherwise marked. If any unmarked number is visible, it is evident that the player has not won in that particular lottery game.

The ticket 12 may then be translated further through slot 17 until the letter B is visible at window 22 and the second array 14 of numbers on the ticket may be checked to determine if the winning combination has been marked. The process may then be repeated to check games C, D and E and to check additional tickets 12 if the player has purchased more than one ticket.

The card reader 11 has no small moving parts in exposed external locations and thus is extremely durable. Manufacture is uncomplicated and thus the device need not be costly. Setting in of a winning combination of numbers is a simple process requiring only pushing motions with the key 37. The device can be compact and is easily carried in a pocket or purse when it is designed for reading small lottery tickets such as the example hereinbefore described.

While the invention has been described with respect to a specific preferred embodiment for purposes of example, many variations and modifications of the construction are possible and it is not intended to limit the invention except as defined in the following claims.

I claim:

1. A device for examining game tickets or the like of the type having an array of numbers or other symbols thereon, selected ones of which numbers or other symbols are marked to forecast a set of winning numbers or other symbols, comprising:

a body member having first and second opposite faces and a slot which is situated between said faces and proportioned to receive at least the portion of said ticket which has said array of numbers or other symbols thereon and further having a plurality of passages extending through said body member including said slot, said passages being located in an array thereof which corresponds to said array of numbers or other symbols on said game ticket or the like, at least said first face having markings thereon which identify each passage with the corresponding one of said numbers or other symbols, and a plurality of slider elements each being disposed in a separate one of said passages and being movable therealong between a first position at which the slider element is located between said slot and said first face and a second position at which said slider element is located between said slot and said second face.

2. The device of claim 1 further including a key having a protuberance proportioned to be entered into said passages to shift said slider elements between said positions thereof, and means for fastening said key to said body member.

3. The device of claim 1 further including means for preventing ejection of said slider elements from said passages.

4. The device of claim 3 wherein said means for preventing ejection of said slider elements from said passages includes constrictions at each end of each of said passages.

5. The device of claim 1 further including means for creating resistance to movement of said slider elements away from said first and second positions thereof.

6. The device of claim 1 wherein said body member is formed of resilient material at least in the region of said passages and wherein said body member has deflectable detent tang projections which extend into each of said passages at each side of said ticket receiving slot, said projections being located to resist movement of said slider elements out of said first and second positions thereof.

7. The device of claim 1 wherein said slot extends through said body member in parallel relationship to said first face thereof.

8. The device of claim 1 for use with a game ticket or the like which has a plurality of said arrays of numbers or other symbols and has indicia adjacent each array which identify that particular array, and wherein said body member has a viewing window in said first face thereof positioned to enable viewing of each indicia when the adjacent array of numbers or other symbols is in register with said passages.

9. The device of claim 1 wherein said passages in said body member are of circular cross section and wherein said slider elements are cylindrical and have diameters conforming to the diameters of said passages.

10. The device of claim 1 wherein at least said first face of said body member and said slider elements are opaque.

11. A checking device for identifying winning lottery tickets or the like which have an array of distinct numbers or other symbols thereon, comprising:

a body member having a face and a slot extending in parallel relationship to said face, said slot being proportioned to receive said lottery tickets or the like and to maintain said lottery tickets or the like in parallel relationship to said face, said body member including said slot being transpierced by a plurality of passages disposed in an array corresponding to said array of numbers or other symbols on said lottery ticket or the like and having markings on said face correlating individual ones of said passages with corresponding ones of said numbers or other symbols of said lottery tickets or the like, and a plurality of opaque slider elements each being disposed in a separate one of said passages for movement therealong between first and second opposite end regions of the passage, said slider elements being proportioned to be out of said slot when at said first and second opposite end regions of said passages.

12. The checking device of claim 11 further including annular lips at each end of each of said passages forming constrictions in each of said passages at each end thereof against which said slider elements seat when at said end regions of said passages.

13. The checking device of claim 12 further including a key having a shank proportioned to be insertable into selected ones of said passages to shift said slider elements between said end regions thereof, and wherein said body member has an opening proportioned to receive a potion of said key and has resilient detents positioned to exert clamping pressure on said key when said portion thereof is in said opening whereby said key is retained by said body member but may be withdrawn when needed for shifting of said slider elements.

14. The checking device of claim 11 wherein said slot extends through said body member in order to receive lottery tickets or the like which are longer than the passageway defined by said slot and which have a plurality of said arrays of numbers or other symbols and which have additional markings adjacent each array that identify the particular array, and wherein said body member has a viewing window extending from said face to said slot, said viewing window being positioned to enable viewing of said additional markings when said lottery tickets or the like are inserted in said slot.

* * * * *